US011799252B2

(12) United States Patent
Sultenfuss et al.

(10) Patent No.: US 11,799,252 B2
(45) Date of Patent: Oct. 24, 2023

(54) HIGH PERFORMANCE SINGLE BARREL POWER CONNECTION

(71) Applicant: Dell Products L.P., Round Rock, TX (US)

(72) Inventors: Andrew Thomas Sultenfuss, Leander, TX (US); Tsung-Cheng Liao, Taoyuan (TW); Wei-Cheng Yu, New Taipei (TW); Chi-Che Wu, Taipei (TW)

(73) Assignee: Dell Products L.P.

( * ) Notice: Subject to any disclaimer, the term of this patent is extended or adjusted under 35 U.S.C. 154(b) by 101 days.

(21) Appl. No.: 17/648,729

(22) Filed: Jan. 24, 2022

(65) Prior Publication Data

US 2023/0238750 A1 Jul. 27, 2023

(51) Int. Cl.

| | |
|---|---|
| ***H01R 24/38*** | (2011.01) |
| ***H01R 43/20*** | (2006.01) |
| ***H01R 13/03*** | (2006.01) |
| ***H01R 103/00*** | (2006.01) |

(52) U.S. Cl.

CPC ..... *H01R 24/38* (2013.01); *H01R 43/20* (2013.01); *H01R 13/03* (2013.01); *H01R 2103/00* (2013.01)

(58) Field of Classification Search

CPC ..... H01R 24/38; H01R 13/03; H01R 43/20; H01R 2103/00

See application file for complete search history.

(56) References Cited

U.S. PATENT DOCUMENTS

| | | | | |
|---|---|---|---|---|
| 8,162,672 | B2 * | 4/2012 | Huang | H01R 13/11 439/63 |
| 10,741,972 | B2 * | 8/2020 | Iwamoto | H01R 13/6581 |
| 2005/0245104 | A1 * | 11/2005 | Nakagawa | H01R 24/42 439/63 |

* cited by examiner

*Primary Examiner* — Oscar C Jimenez

(74) *Attorney, Agent, or Firm* — McDermott Will & Emery LLP

(57) ABSTRACT

A high-performance single barrel power connector for receiving electric power may be capable of receiving more than 330 W up to approximately 600 W of power. The V+ pin and V− pin may each be configured with a large plurality of contact points for connecting to a power plug. A connector body retaining the V+ pin and V− pin may configured with openings to expose more of the V+ pin and V− pin to air and allow the V+ pin and V− pin to extend out of the power connector for convective and conductive heat transfer. A shell having a high thermal conductivity may be connected to the V− pin and V− pin and further connected to a bracket for increased heat transfer away from the V+ and V− pins.

20 Claims, 11 Drawing Sheets

HIGH PERFORMANCE SINGLE BARREL POWER CONNECTION

BACKGROUND

Field of the Disclosure

This disclosure relates generally to information handling systems and, more particularly, to single-barrel power connectors capable of providing nigh power for greater performance of the information handling systems.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems receive power from connectors commonly referred to as barrel connectors, in which a barrel receives a pin to form an electrical connection. As processing and communication speeds increase, these connectors must be able to receive more power.

SUMMARY

Embodiments disclosed herein may be generally directed to single-barrel power connectors for use in high performance information handling systems. As used herein, the term "high performance" may refer to a power connector capable of receiving more than 330 W up to about 600 W of power. The term "high performance" may also refer to performance of an information handling system that is supplied with power greater than 330 W at 20 VDC up to about 600 W at 20 VDC. Embodiments include a high-performance single barrel power connector comprising a connector body configured with an opening for receiving a power plug of a power source, a V+ pin, a V+ pin and a signal pin accessible through the opening in the connector body, a cover connected to the connector body, wherein the V− pin contact points, the V+ pin contact points and the signal pin second end extend through the cover, and a shell coupled to the connector body. A power connector receiving more than 300 W of power from a standard 7.4 mm barrel plug will overheat, which may cause damage to the plug, the power connector, or the information handling system. Embodiments of a high performance power connector have several improvements that enable a standard 7.4 mm barrel plug to deliver power greater than 330 W to an information handling system and which collectively enable an information handling system to operate as a high performance information handling system up to 600 W without increasing the size of the barrel plug.

Embodiments include a high-performance single barrel power connector comprising a connector body configured with an opening for receiving a power plug of a power source, a V− pin, a V+ pin and a signal pin accessible through the opening in the connector body, a cover connected to the connector body, wherein the V− pin contact points, the V+ pin contact points and the signal pin second end extend through the cover, and a shell coupled to the connector body.

The V− pin comprises a first end with a plurality of V− pin contact areas and a second end with a pair of V− pin contact points. The V+ pin comprises a first end with a plurality of V+ pin contact areas and a second end with a pair of V+ pin contact points, and the V+ pin is aligned coaxial with the V− pin. The signal pin has a first end accessible through the opening. The cover is connected to the connector body, wherein the negative pin contact points, the V+ pin contact points and the signal pin second end extend through the cover. The shell is coupled to one or more of the connector body and the cover and is formed from a high thermal conductivity material. The shell comprises a first set of V− pin tabs for contact with the first end of the V− pin and a second set of V− pin tabs for contact with the V− pin contact points.

In some embodiments, the connector body comprises one or more openings to expose a portion of one or more of the V− pin and the V+ pin to ambient air.

In some embodiments, the shell comprises a set of retainers for coupling the shell to the connector body and the cover. In some embodiments, the shell comprises C5210. In some embodiments, the V− pin contact points are separated from each other by a distance and oriented at an angle relative to each other. In some embodiments, the V− pin contact points are oriented at an angle between forty-five degrees and ninety degrees relative to each other.

In some embodiments, the V− pin comprises brass and the V+ pin comprises copper.

Manufacturing a high-performance single barrel power connector may comprise forming a connector body with an opening configured for receiving a power plug corresponding to a power source positioning a V− pin in the connector body, wherein a V− pin first end is accessible through the opening in the connector body and the V− pin first end comprises a plurality of V− pin contact areas configured for contact with the power plug, positioning a V+ pin in the connector body, wherein a V+ pin first end is accessible through the opening in the connector body and comprises a plurality of V+ pin contact areas configured for contact with the power plug, positioning a signal pin in the connector body, wherein a signal pin first end is accessible through the opening in the connector body, connecting a cover to the connector body, wherein the pair of V− pin contact points, the pair of V+ pin contact points and the signal pin second end extend through the cover, and coupling a shell formed from a high thermal conductivity material to the connector body, wherein coupling to shell to the connector body comprises positioning a first set of V− pin tabs in contact with the V− pin first end and positioning a second set of V− pin tabs in contact with the pair of V− pin contact points.

BRIEF DESCRIPTION OF THE DRAWINGS

For a more complete understanding of the invention and its features and advantages, reference is now made to the following description, taken in conjunction with the accompanying drawings, in which.

DESCRIPTION OF PARTICULAR EMBODIMENT(S)

Figure 1A:
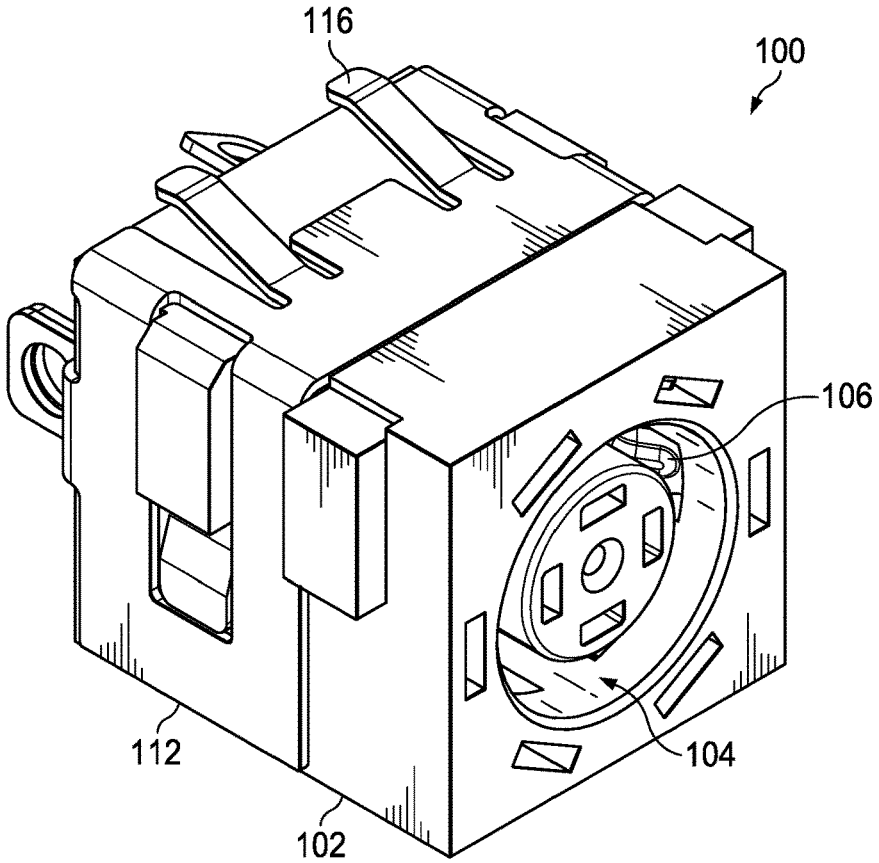
FIGS. 1A-1C depict views of a common barrel connector for a 7.4 mm power connector capable of receiving up to approximately 330 W of electric power.

In the following description, details are set forth by way of example to facilitate discussion of the disclosed subject matter. It should be apparent to a person of ordinary skill in the field, however, that the disclosed embodiments are exemplary and not exhaustive of all possible embodiments.

For the purposes of this disclosure, an information handling system may include an instrumentality or aggregate of instrumentalities operable to compute, classify, process, transmit, receive, retrieve, originate, switch, store, display, manifest, detect, record, reproduce, handle, or utilize various forms of information, intelligence, or data for business, scientific, control, entertainment, or other purposes. For example, an information handling system may be a personal computer, a consumer electronic device, a network storage device, or another suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and one or more video displays. The information handling system may also include one or more buses operable to transmit communication between the various hardware components.

Components of an information handling system may include, but are not limited to, a processor subsystem, which may comprise one or more processors, and a system bus that communicatively couples various system components to processor subsystem including, for example, a memory subsystem, an I/O subsystem, local storage resource, and network interface.

A processor subsystem may comprise a system, device, or apparatus operable to interpret and execute program instructions and process data, and may include a microprocessor, microcontroller, digital signal processor (DSP), application specific integrated circuit (ASIC), or another digital or analog circuitry configured to interpret and execute program instructions and process data. In some embodiments, a processor subsystem may interpret and execute program instructions and process data stored locally (e.g., in memory subsystem). In the same or alternative embodiments, a processor subsystem may interpret and execute program instructions and process data stored remotely (e.g., in a network storage resource).

A system bus may refer to a variety of suitable types of bus structures, e.g., a memory bus, a peripheral bus, or a local bus using various bus architectures in selected embodiments. For example, such architectures may include, but are not limited to, Micro Channel Architecture (MCA) bus, Industry Standard Architecture (ISA) bus, Enhanced ISA (EISA) bus, Peripheral Component Interconnect (PCI) bus, PCI-Express bus, HyperTransport (HT) bus, and Video Electronics Standards Association (VESA) local bus.

A memory subsystem may comprise a system, device, or apparatus operable to retain and retrieve program instructions and data for a period of time (e.g., computer-readable media). A memory subsystem may comprise random access memory (RAM), electrically erasable programmable read-only memory (EEPROM), a PCMCIA card, flash memory, magnetic storage, opto-magnetic storage, and/or a suitable selection and/or array of volatile or non-volatile memory that retains data after power to its associated information handling system is powered down.

An I/O subsystem in an information handling system may comprise a system, device, or apparatus generally operable to receive and transmit data to or from or within an information handling system. An I/O subsystem may represent, for example, a variety of communication interfaces, graphics interfaces, video interfaces, user input interfaces, and peripheral interfaces. In various embodiments, an I/O subsystem may be used to support various peripheral devices, such as a touch panel, a display adapter, a keyboard, a touch pad, or a camera, among other examples. In some implementations, an I/O subsystem may support so-called 'plug and play' connectivity to external devices, in which the external devices may be added or removed while an information handling system is operating.

A local storage resource may comprise computer-readable media (e.g., hard disk drive, floppy disk drive, CD-ROM, and other type of rotating storage media, flash memory, EEPROM, or another type of solid-state storage media) and may be generally operable to store instructions and data.

A network interface may be a suitable system, apparatus, or device operable to serve as an interface between an information handling system and a network (not shown). A network interface may enable an information handling system to communicate over a network using a suitable transmission protocol or standard. In some embodiments, a network interface may be communicatively coupled via a network to a network storage resource (not shown). A network coupled to a network interface may be implemented as, or may be a part of, a storage area network (SAN), personal area network (PAN), local area network (LAN), a metropolitan area network (MAN), a wide area network (WAN), a wireless local area network (WLAN), a virtual private network (VPN), an intranet, the Internet or another appropriate architecture or system that facilitates the communication of signals, data and messages (generally referred to as data). A network coupled to a network interface may transmit data using a desired storage or communication protocol, including, but not limited to, Fibre Channel, Frame Relay, Asynchronous Transfer Mode (ATM), Internet protocol (IP), other packet-based protocol, small computer system interface (SCSI), Internet SCSI (iSCSI), Serial Attached SCSI (SAS) or another transport that operates with the SCSI protocol, advanced technology attachment (ATA), serial ATA (SATA), advanced technology attachment packet interface (ATAPI), serial storage architecture (SSA), integrated drive electronics (IDE), or any combination thereof. A network coupled to a network interface or various components associated therewith may be implemented using hardware, software, or any combination thereof.

Figure 1B:
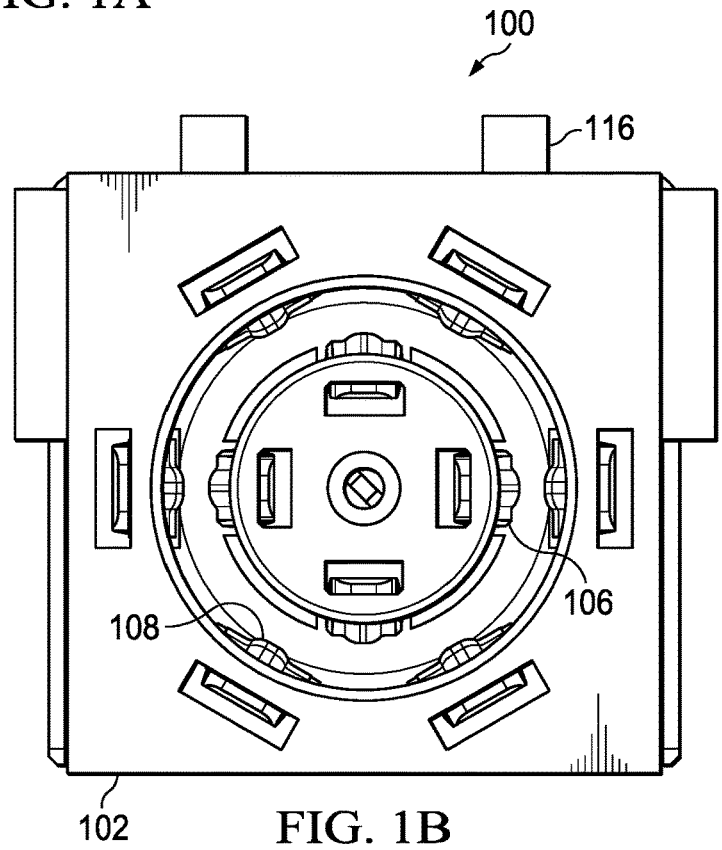
Figure 1C:
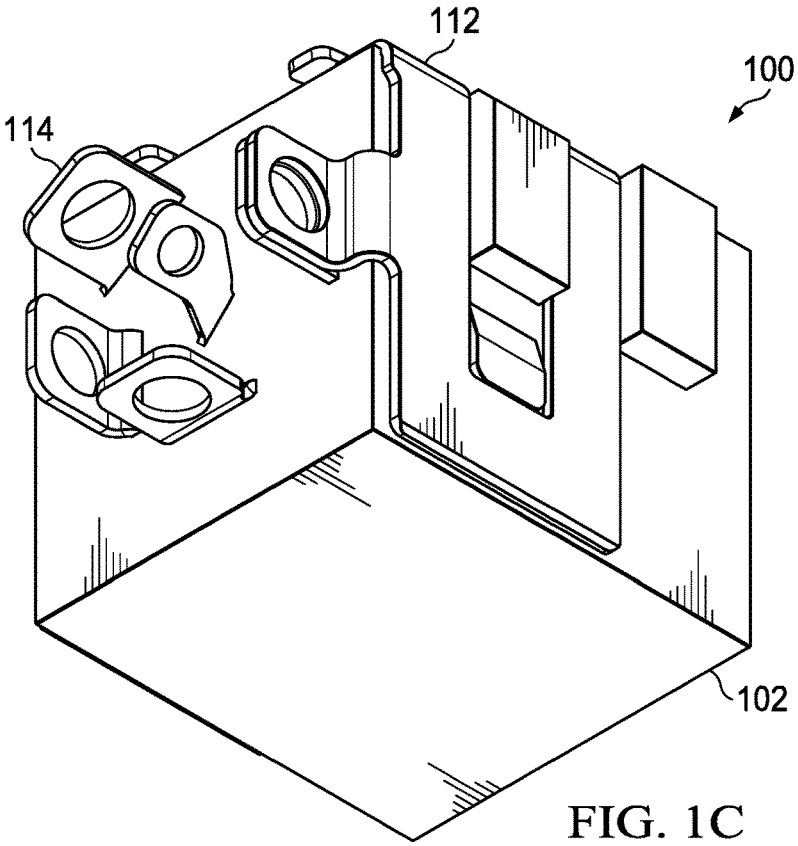

Historically, electrical power is provided by a connection formed by a plug inserted into a single barrel power connector. FIGS. 1A, 1B and 1C depict front perspective, front and back perspective views, respectively, of a common single barrel connector 100. In these connectors, a plug (not shown) is inserted into circular opening 104 in connector body 102, wherein an inner surface of the plug contacts V+ surface areas 106 and an outer surface of the plug contacts V− contact areas 108. A connector shell 112 couples to connector body 102 to enclose components of connector 100, wherein electrical contacts 114 extend through connector shell 110 for routing electric power to appropriate subsystems and components of information handling system. The design of connector 100 results in heat buildup, particularly in V+ and V− contact areas 106, 108 such that electric power supplied to an information handling system is limited due to connector 100. These single barrel connectors 100 accept standard 7.4 mm plugs and can receive up to 330 W of power.

Figure 2A:
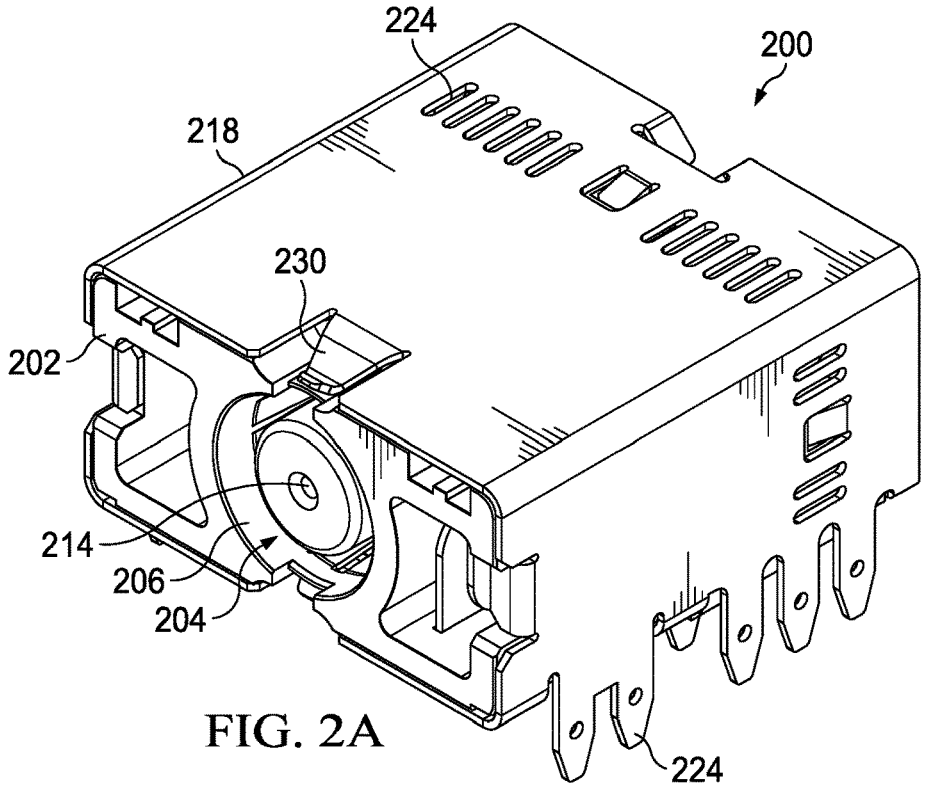
FIGS. 2A-2C depict views of an embodiment of a high-performance single barrel power connector for a 7.4 mm power connector.
Figure 2B:
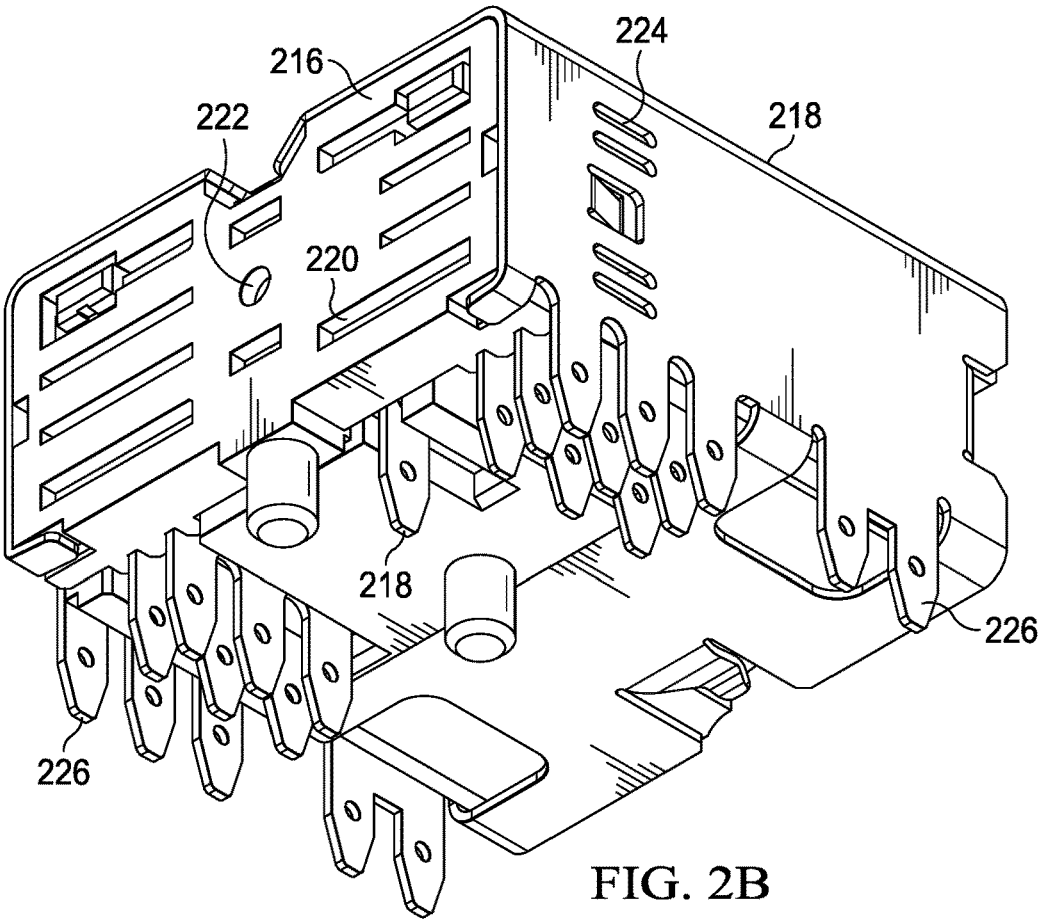
Figure 2C:
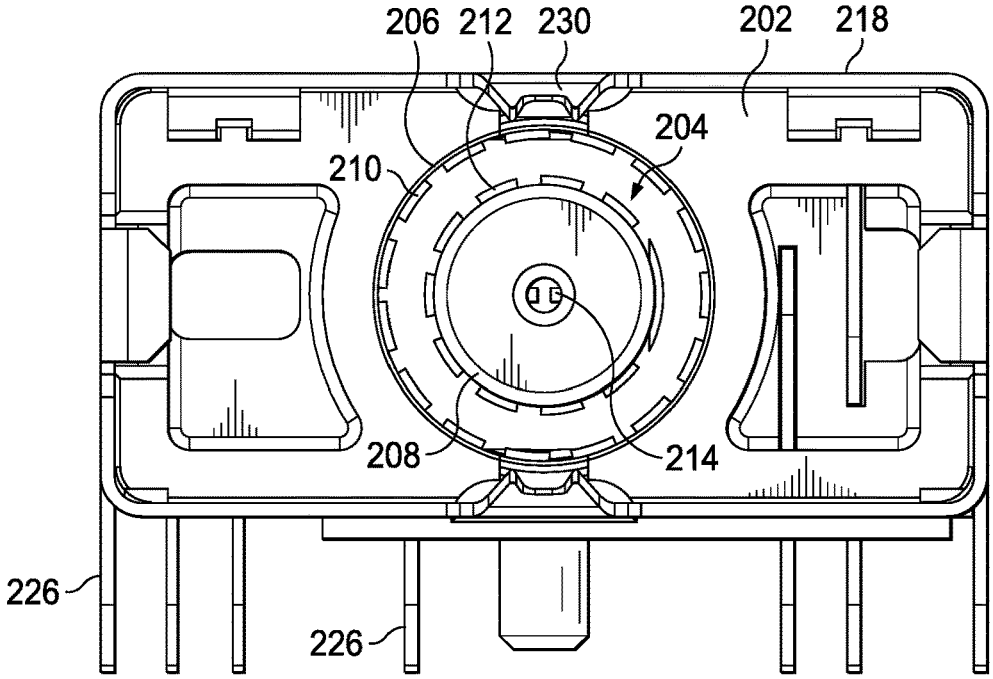

FIGS. 2A, 2B and 2C depict front perspective, back perspective, and front views, respectively, of one embodiment of a high-performance single barrel power connector 200 capable of connecting to a standard 7.4 mm plug for supplying more power to components of an information handling systems. As described herein, power connector 200 is described as connectable to a standard 7.4 mm plug. However, other plug sizes are possible.

Power connector 200 comprises connector body 202 with opening 204 for receiving a plug (not shown) with a circular cross-section area. V− pin 206 comprises V− pin contact areas 210 and V+ pin 208 comprises V+ pin contact areas 212, wherein a plug inserted in opening 204 contacts V− pin contact areas 210 and V+ pin contact areas 212 to supply power to an information handling system. Signal pin 214 is positioned inside V+ pin 208 for signaling the information handling system when power is being supplied.

Cover 216 and shell 218 surround portions of connector body 202. Cover 216 may include vents 220 to allow airflow into and out of power connector 200. In some embodiments, cover 216 comprises signal pin access port 222 for communicatively connecting signal pin 214 to a processor in the information handling system.

Shell 218 may be formed from a thermally conductive material and comprises vents 224 for increased airflow through power connector 200 for increased convective heat transfer. In some embodiments, shell 218 comprises extensions 226 for coupling to a chassis (not shown) of an information handling system, wherein the thermally conductive material and extensions 226 may provide multiple paths for conductive heat transfer from power connector 200 to the chassis. In some embodiments, shell 218 comprises V− pin contact tab 230 for contact with V− pin 206, wherein V− pin contact tab 230 provides a path for conductive heat transfer from V− pin 206 to shell 218.

Electrical contacts may extend through cover 216 for routing electric power to appropriate subsystems and components of an information handling system.

Power connector 200 provides improved thermal conduction away from power connector to allow for increased power supply to an information handling system while concealing connections to V− pin 206, V+ pin 208 and signal pin 214.

Referring to FIGS. 3, 4, 5, 6A-6B, 7A-7B and 8A-8B, embodiments of a high-performance single barrel power connector 300 may have an open design and are capable of receiving up to 600 W of electric power at 20 VDC, even when coupled to a single 7.4 mm plug.

Overview

Figure 3:
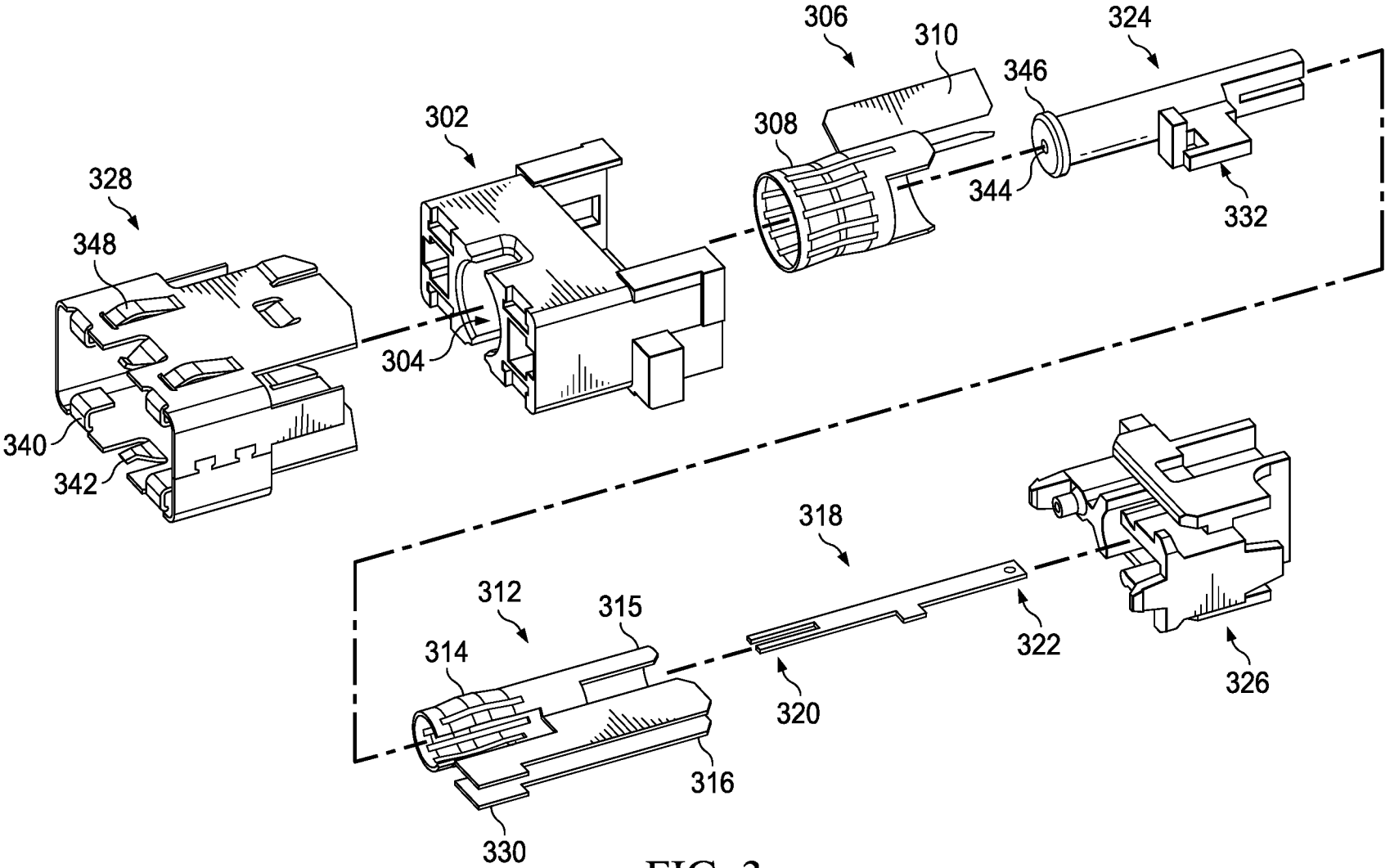
FIG. 3 depicts an exploded view of an embodiment of a high-performance single barrel power connector.

Referring to FIG. 3, power connector 300 comprises connector body 302, V− pin 306, V+ pin 312, signal pin 318, pin separator 324, cover 326 and shell 328.

Referring to one or more of FIGS. 3, 4, 5, 6A-6B, 7A-7B and 8A-8B, connector body 302 is configured with opening 304 for receiving a power plug (shown in FIGS. 7A and 8A) of a power source and further comprises openings 350 to allow V+ pin fins 330 to extend through connector body 302 and recesses 352 for engagement with shell 328, discussed below in more detail. Connector body 302 may have other openings 350 or relief areas for greater exposure to airflow.

V− pin 306 has a first end comprising a plurality of V− pin contact areas 308 and a second end comprising a plurality of V− pin contact points 310. Each V− pin contact area 308 is separated from an adjacent V− pin contact area 308 by a slot or other opening. The first end may have a generally circular cross-section area. In some embodiments, the first end of V− pin 306 is discontinuous, discussed in greater detail below. V− pin contact points 310 may be separated from each other by a distance and oriented non-parallel to each other. The angle and spacing between V− pin contact points 310 allows for greater convective heat transfer.

V+ pin 312 has a first end comprising a plurality of V+ pin contact areas 314, second end 315 and a plurality of V+ pin contact points 316. V+ pin 312 further comprises V+ pin fins 330 extending in a first direction such that they extend through openings 350 in connector body 302 for convective heat transfer.

Signal pin 318 comprises a first end 320 configured to extend through connector body 302 and a second end comprising signal pin contact 322. When a plug is inserted in power connector 300, first end 320 may receive power and signal pin contact 322 may communicate a signal to the information handling system indicating electric power is available.

Pin separator 324 comprises an electrically insulating material and may be positioned inside V− pin 306 and V+ pin 312 but maintain separation between V− pin 306 and V+ pin 312. Pin separator opening 344 allows the first end of signal pin 318 to extend through pin separator 324, allowing an information handling system to determine when a power plug is inserted in power connector 300. As visible in FIGS.

3 and 4, pin separator extension 332 may extend between V+ pin fins 330 to maintain positioning of V+ pin 312.

Figure 5:
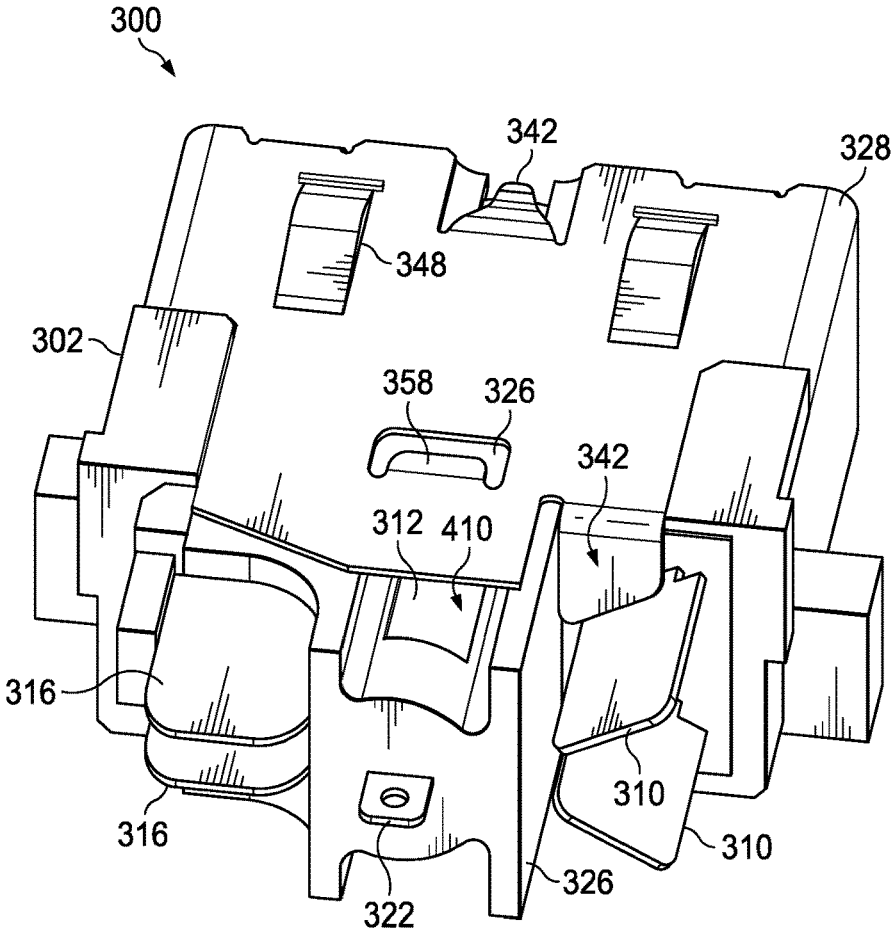
FIG. 5 depicts a perspective back view of the embodiment of a high-performance single barrel power connector depicted in FIG. 3.

Referring to FIG. 5, cover 326 is configured to retain the second ends of V− pin 306, V+ pin 312 and signal pin 318. Cover 326 may be configured to allow the second ends of V− pin 306, V+ pin 312 and signal pin 318 to extend out of power connector 300. During assembly, cover 326 may couple to connector body 302. In some embodiments, cover 326 may have engagement features for coupling to one or more of connector body 302 or shell 328. For example, as depicted in FIG. 5, cover 326 may be configured for engaging with retaining tab 358 of shell 328 during assembly.

Figure 6A:
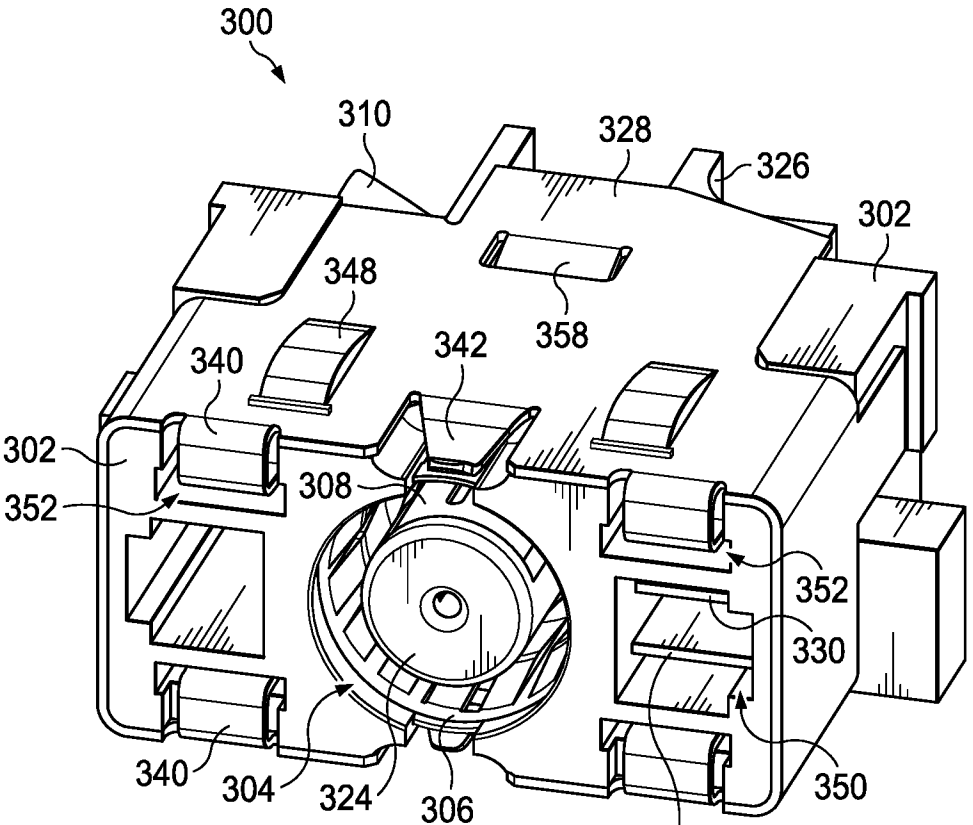
FIG. 6A depicts a perspective front view of the embodiment of a high-performance single barrel power connector depicted in FIG. 3.
Figure 6B:
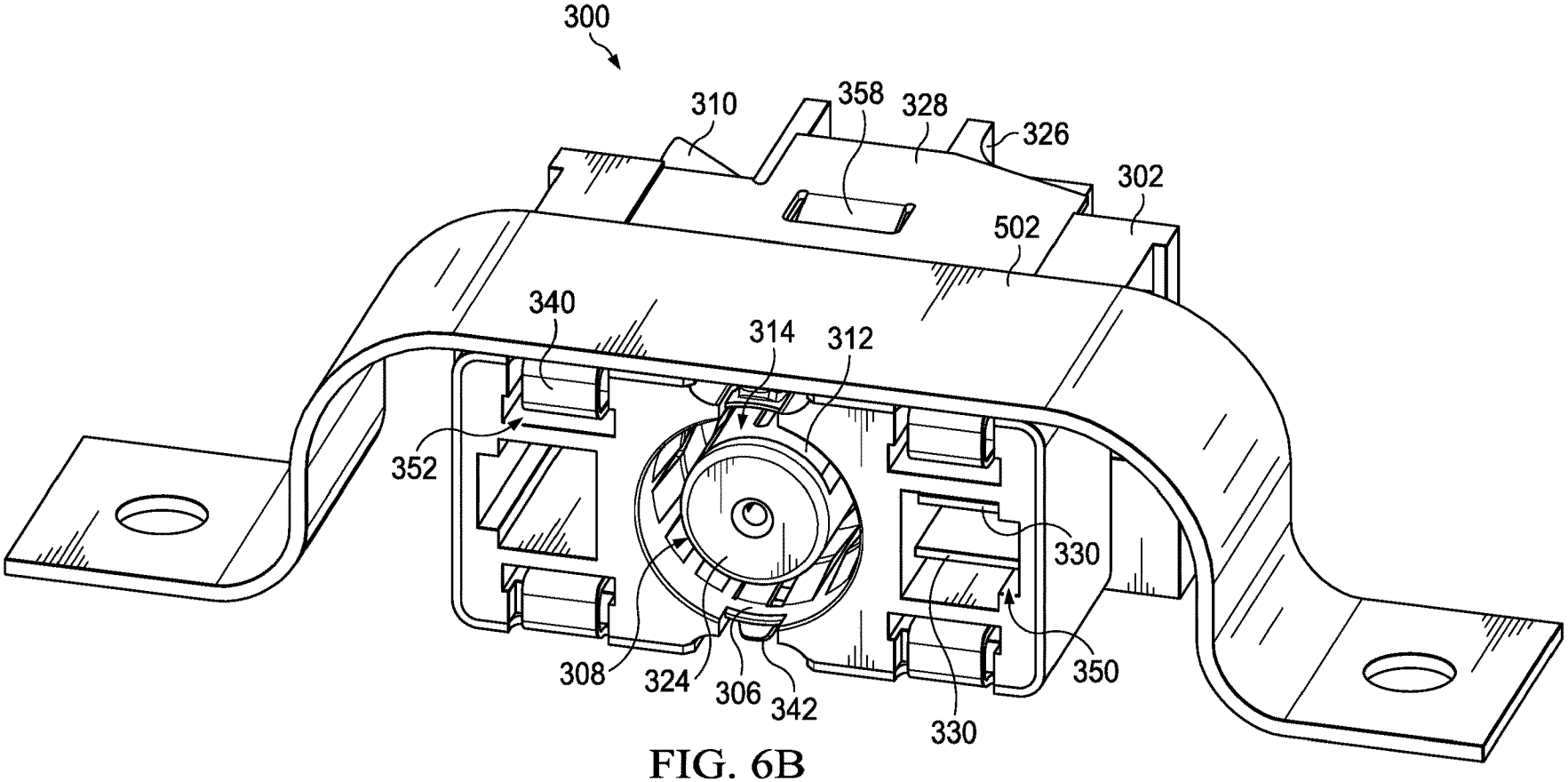
FIG. 6B depicts a perspective front view of the embodiment of a high-performance single barrel power connector depicted in FIG. 3 with a bracket for increased heat transfer.
Figure 7A:
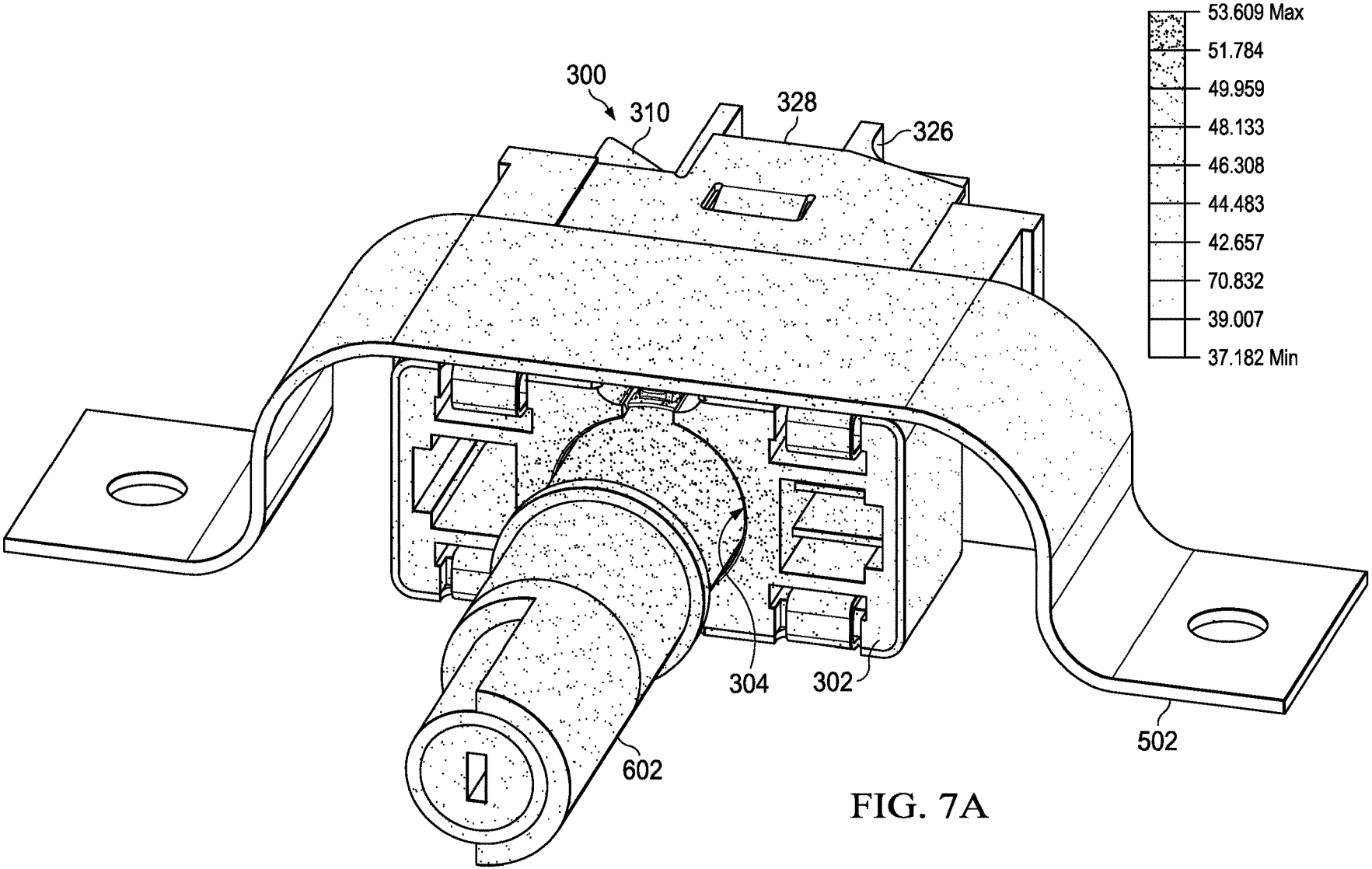
FIGS. 7A and 7B depict images of simulated temperature profiles of the embodiment of a high-performance single barrel power connector depicted in FIG. 3 with the V− pin and V+ pin formed from a single material.
Figure 8A:
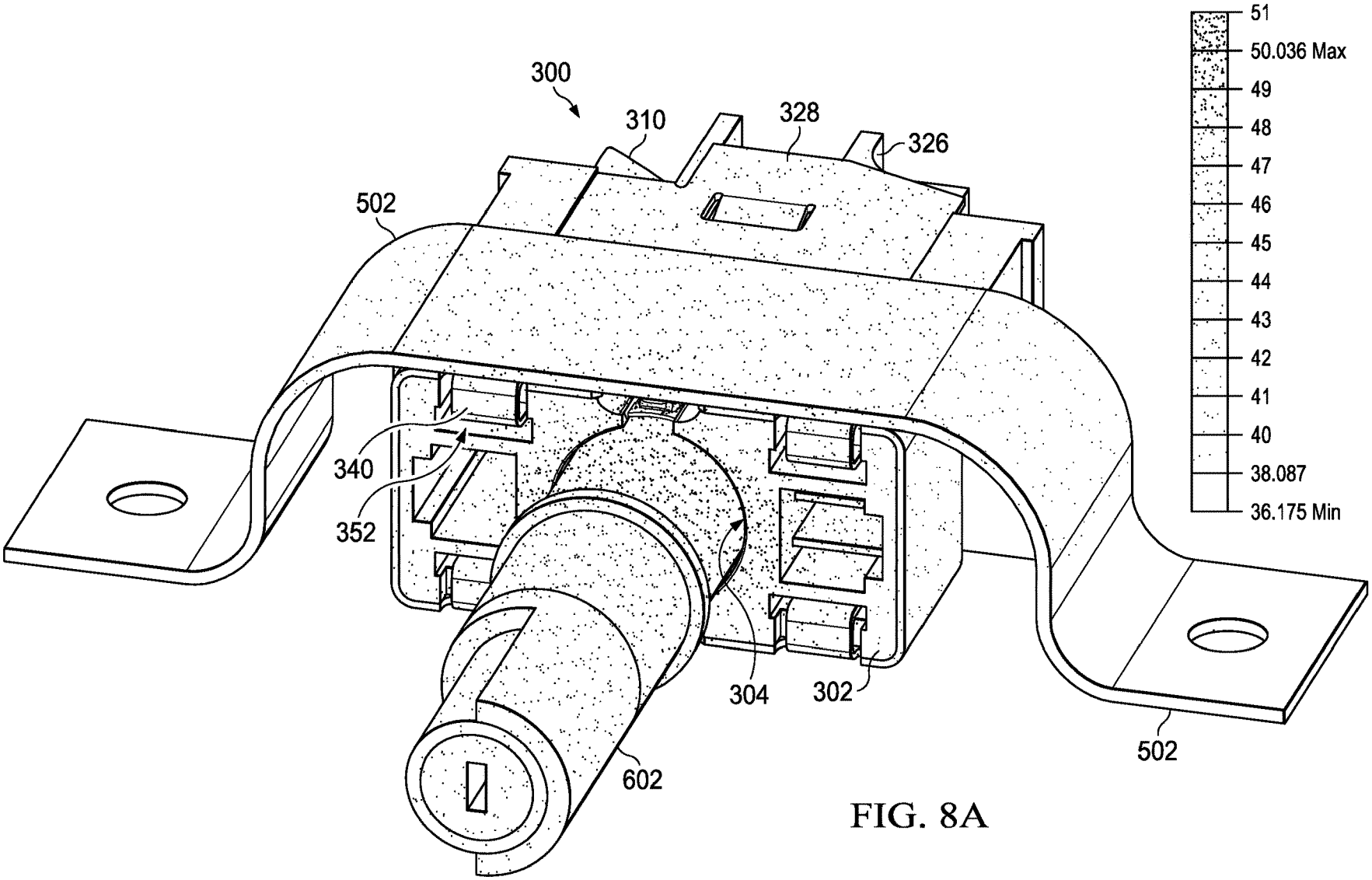
FIGS. 8A and 8B depict images of simulated temperature profiles of the embodiment of a high-performance single barrel power connector depicted in FIG. 3 with a V+ pin formed from a first material and a V− pin formed from a second material.

Referring to FIGS. 3, 4, 6A and 6B, shell 328 is configured for coupling to connector body 302 and cover 326. Shell 328 may be configured with a first set of V− pin tabs 342 for contact with the first end of V− pin 306, wherein the first set of V− pin tabs 342 conduct heat away from the first end of V− pin 306. As depicted in FIG. 5, shell 328 may be configured with a second set of V− pin tabs 342 for contact with V− pin contact points 310, wherein the second set of V− pin tabs 342 conduct heat away from the second end of V− pin 306. The set of V− pin contact tabs 342 may be portions of shell 328 that are shaped or bent to contact V− pin 306. Shell 328 may be configured with retainers 340 for engaging openings 350 or recesses 352 in connector body 302 and may be configured with retaining tab 358 for engaging cover 326. Shell 328 may be configured with raised contact areas 348 for contact with bracket 502, as shown in FIGS. 6B, 7A and 8A. Bracket 502 may couple to a chassis containing an information handling system. V− pin 306 and V+ pin 314 provide negative and positive points for the flow of DC power into an information handling system. Signal pin 322 may detect when plug 602 is inserted in power connector 300.

Embodiments disclosed herein may comprise a unique mixture of materials and design approach to allow for increased power with reduced temperatures while maintaining a 7.4 mm standard plug. Embodiments may lower pin impedances while enabling higher power density. The design of the power connector improves cooling in a conventional 7.4 mm system footprint. The extended integral V− pin and V+ pin designs, the connector body design, the cover, and the shell allow increased heat dissipation. Plug 602 forms part of a power cord, wherein plug 602 inserted in power connector 300 may be capable of transmitting 600 W at 20 VDC to power connector 300.

V− Pin and V+ Pin Designs Improve Electric Conductance and Reduce Heat Buildup Still referring to one or more of FIGS. 3, 4, 5, 6A-6B, 7A-7B and 8A-8B, each of V− pin 306 and V+ pin 312 may comprise a plurality of contact areas 308 and 314, respectively. In some embodiments, the number of V− pin contact areas 308 comprises ten or more. In some embodiments, the number of V− pin contact areas 308 comprises twelve or more. In some embodiments, the number of V− pin contact areas 308 comprises fifteen or more. In some embodiments, the number of V+ pin contact areas 314 comprises six or more. In some embodiments, the number of V+ pin contact areas 314 comprises eight or more. In some embodiments, the number of V+ pin contact areas 314 comprises nine or more. The larger number of contact areas 308, 314 reduces contact resistance. Furthermore, each of the first ends of V− pin 306 and V+ pin 312 may have a generally circular cross-section but be discontinuous. Having a discontinuous cross section includes each V− pin contact area 308 separated from an adjacent V− pin contact area 308 by a slot extending along a portion of the first end. A discontinuous cross-section may include a slot extending the length of the first end. In some embodiments, V− pin 306 may be configured with slot 356 (visible in FIGS. 7B and 8B) extending along a length of V− pin 306, wherein a spring constant associated with the material and dimensions of V− pin 306 ensures an inner surface of V− pin 306 remains in contact with an outer surface of plug 602 when plug 602 is inserted into power connector 300. In some embodiments, V+ pin 312 may be configured with slot 360 (visible in FIGS. 7B and 8B) extending along a length of V+ pin 312, wherein a spring constant associated with the material and dimensions of V+ pin 312 ensures an outer surface of V+ pin 312 remains in contact with an inner surface of plug 602 when plug 602 is inserted into power connector 300.

Referring to FIGS. 7A-7B and 8A-8B, embodiments comprising V− pin 306 formed from a high thermal conductivity and configured with a large number of V− pin contact areas 308 separated by a plurality of slots extending partially along the length of the first end of V− pin 306 may improve heat conduction away from the first end of V− pin 306. In some embodiments, V− pin 306 configured with slot 756 and a spring constant improves contact between V− pin contact areas 308 and plug 602 inserted in power connector 300. Embodiments comprising V+ pin 312 formed from a high thermal conductivity and configured with a large number of V+ pin contact areas 314 separated by a plurality of slots extending partially along the length of the first end of V+ pin 312 may improve heat conduction away from the first end of V+ pin 312. In some embodiments, V+ pin 312 configured with slot 760 and a spring constant improves contact between V+ pin contact areas 314 and plug 602 inserted in power connector 300.

Figure 7B:
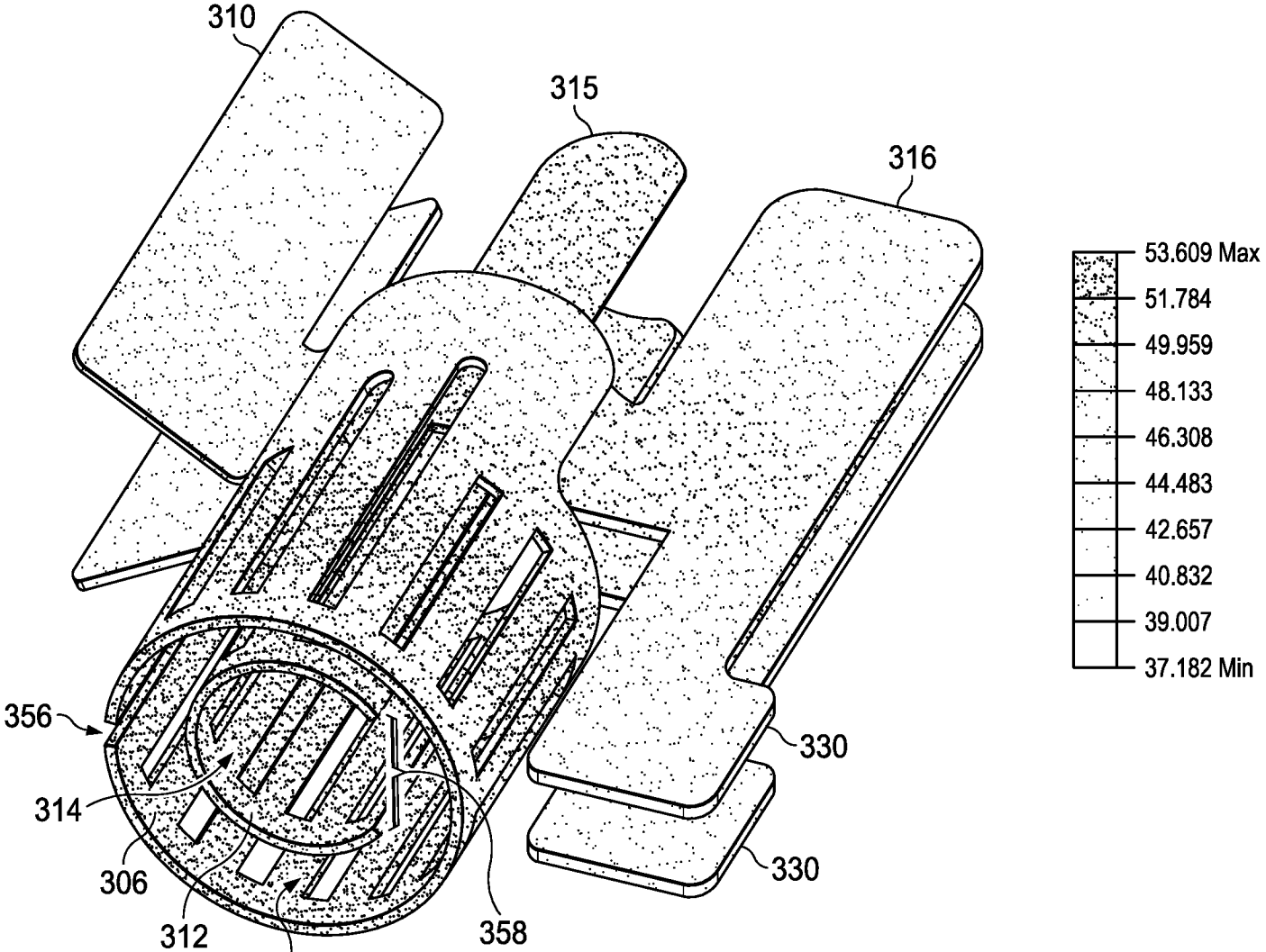

In some embodiments, one or more of V− pin 306 and V+ pin 312 are formed from brass. FIG. 7A depicts a temperature profile of power connector 300 in which both V− pin 306 and V+ pin 312 are formed with brass material and FIG. 7B depicts a temperature profile of V− pin 306 and V+ pin 312. Brass is often used because brass is relatively inexpensive. However, as depicted in FIG. 7A, in a simulation in which power connector 300 received 30 A of power, V+ pin 312 reached a temperature of approximately 53.6 C in an ambient temperature of 25 C. Furthermore, as depicted in FIG. 7B, the temperature of V+ pin 312 was higher than the temperature of V− pin 306. Thus, the lower cost of brass was offset by the higher overall thermal profile and a large temperature differential between V− pin 306 and V+ pin 312.

Although not depicted, in some embodiments, both V− pin 306 and V+ pin 312 may be formed from red copper. An advantage to using copper may be the increase in thermal conductivity, particularly as compared with brass. In a simulation in which 30 A of power was supplied to power connector 300 comprising both V− pin 306 and V+ pin 312 formed from red copper, the temperature reached approximately 48.6 C in a 25 C ambient environment, which was a significant improvement over power connector 300 comprising both V− pin 306 and V+ pin 312 formed with brass described above. However, copper is typically more expensive. Furthermore, there was still an undesirable large temperature differential between V+ pin 312 and V− pin 306.

Figure 8B:
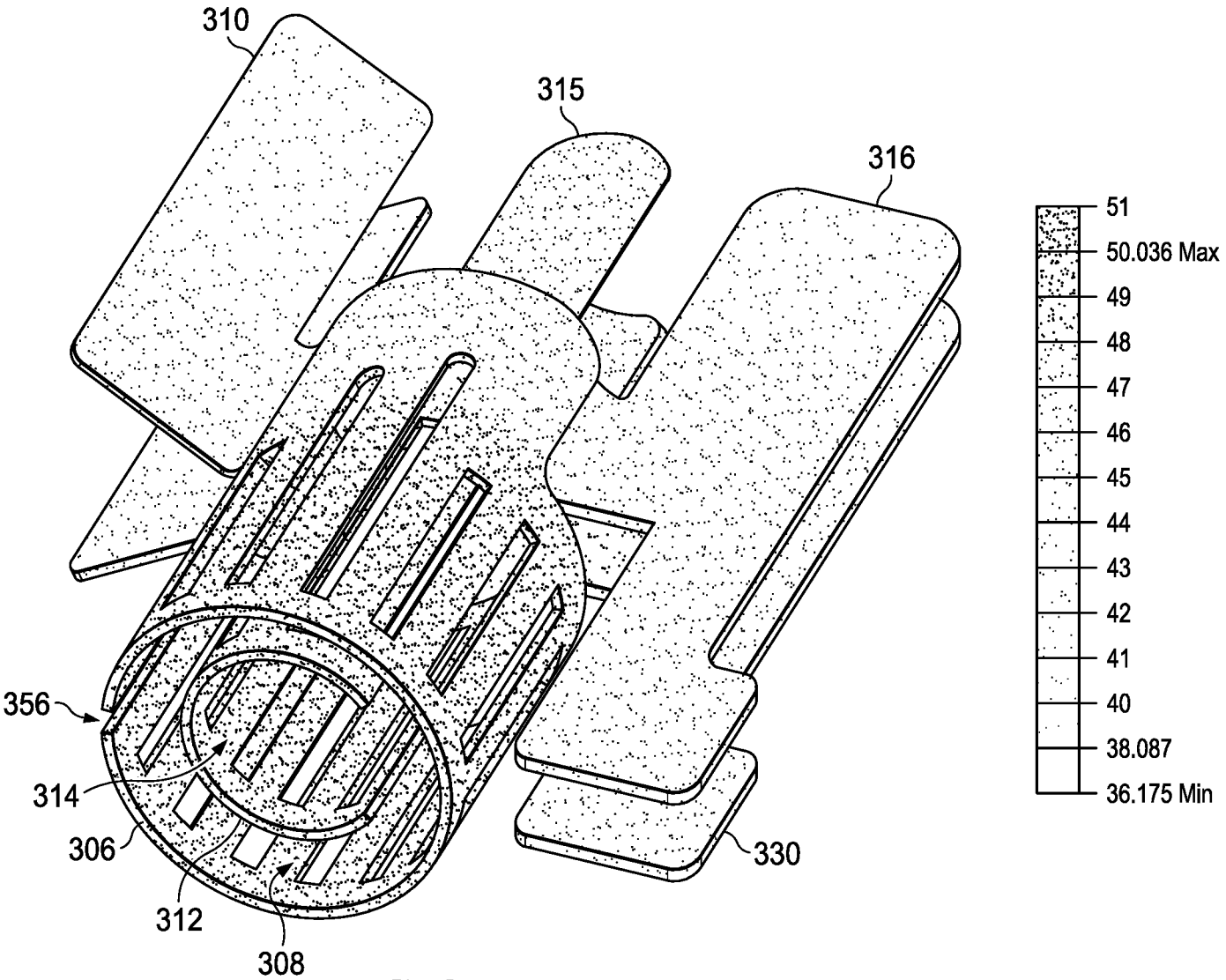

In some embodiments, V− pin 306 may be formed from brass and V+ pin 312 may be formed from copper. FIG. 8A depicts a temperature profile of power connector 300 in which V− pin 306 was formed with brass material and V+ pin 312 was formed with red copper material and FIG. 8B depicts a temperature profile of V− pin 306 and V+ pin 312. In testing this configuration, the temperature differential between V− pin 306 and V+ pin 312 was less than 1 C and the temperatures of both V− pin 306 and V+ pin 312 were less than 50 C. Thus, although more expensive than an embodiment forming both V− pin 306 and V+ pin 312 with brass, embodiments configured with V− pin 306 formed with brass and V+ pin 312 formed with copper achieved almost the same overall temperature as power connector 300 in which both V− pin 306 and V+ pin 312 were formed with copper, and with a smaller temperature differential.

Shell Conducts Heat from Both Ends of V− Pin

Shell 328 comprises a material for high thermal conductivity and configured for improved heat transfer away from V− pin 306 and V+ pin 312. In some embodiments, shell 328 comprises an alloy such as C5210 material.

Cover with Exposed V− Pin Contact Points and V+ Pin Contact Points Improves Convective and Conductive Cooling Referring to FIG. 5, cover 326 is configured to retain the second ends of V− pin 306, V+ pin 312 and signal pin 318 and for improved heat transfer away from V− pin 306 and V+ pin 312. Cover 326 may be configured to allow the second ends of V− pin 306, V+ pin 312 and signal pin 318 to extend out of power connector 300. Higher exposed surface area of V− pin contact points 310 and V+ pin contact points 316 allows more airflow for improved convective heat transfer. Cover 326 may be formed with a center portion configured such that V− pin contact points 310 extend out cover 326 on a first side of the center portion and V+ pin contact points 316 extend out cover 326 on a second side of the center portion, whereby heat associated with each of V− pin 306 and V+ pin 312 may be addressed independently. The center portion may contain and insulate the second end of signal pin 318 from V− pin contact points 308 and V+ pin contact points 316. As depicted in FIG. 5, in some embodiments, cover 326 may comprise openings 410 exposing V+ pin 312.

Advantageously, instead of completely covering V− pin 306, V+ pin 312 and signal pin 318 as depicted in FIG. 1C such that heat builds up inside, cover 326 allows for airflow for convective heat transfer. Furthermore, instead of completely covering V− pin 306, V+ pin 312 and signal pin 318 as depicted in FIG. 1C such that heat builds up inside, cover 326 allows for contact with shell 328 for conductive heat transfer away from V− pin contact points 308 and V+ pin contact points 312.

Figure 4:
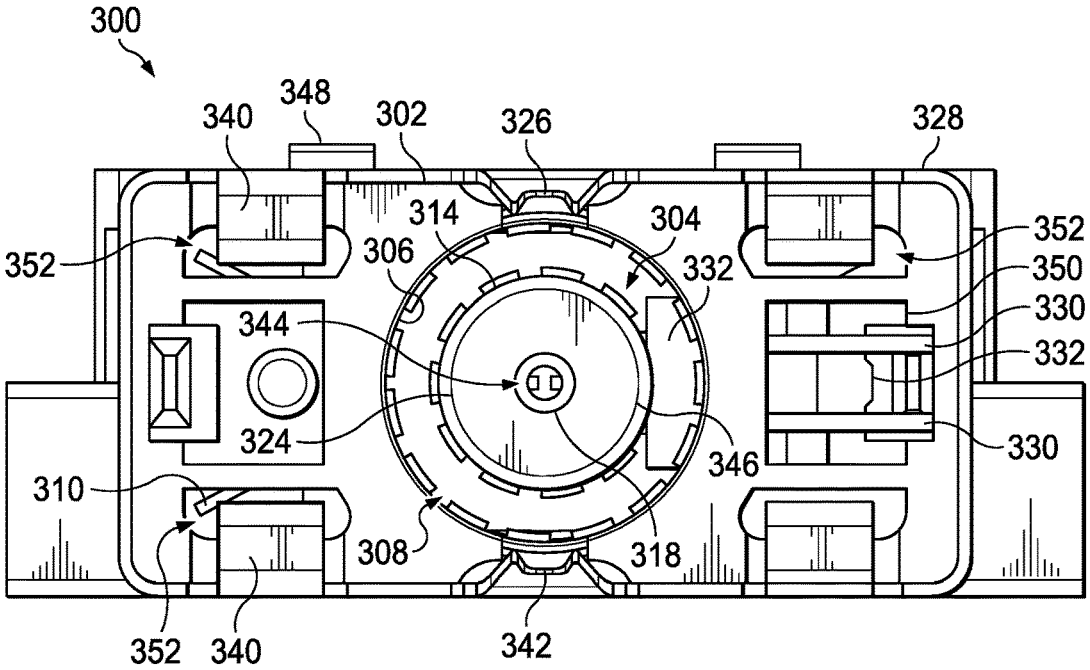
FIG. 4 depicts a front view of the embodiment of a high-performance single barrel power connector depicted in FIG. 3.

Connector Body, Pin Separator and Cover Maintain Separation of V− Pin, V+ Pin and Signal Pin Referring to FIGS. 3, 4 and 5, when power connector 300 is assembled, connector body 302, pin separator 324 and cover 326 maintain separation between V− pin 306, V+ pin 312 and signal pin 318. Pin separator 324 may be inserted in V− pin 306, whereby flange 346 on pin separator 324 may contact an inner surface of V− pin 306. V+ pin 312 may be positioned on pin separator 324, whereby one or more of pin separator extension 332 and flange 346 may prevent V+ pin 312 from contacting V− pin 306. Opening 344 in pin separator 324 may extend along pin separator 324 to maintain signal pin 318 coaxial with V− pin 306 and V+ pin 312. Cover 326 may also be configured to retain the second ends of V− pin 306, V+ pin 312 and signal pin 318 to prevent contact between V− pin 306, V+ pin 312 and signal pin 318.

Embodiments of a high-performance power connector can deliver higher power levels, support interoperability, power supply identification. Furthermore, embodiments described herein may be configured to maintain a minimum system socket height, rigidity/reliability, and thermal levels over conventional plug power systems.

The above disclosed subject matter is to be considered illustrative, and not restrictive, and the appended claims are intended to cover all such modifications, enhancements, and other embodiments which fall within the true spirit and scope of the disclosure. Thus, to the maximum extent allowed by law, the scope of the disclosure is to be determined by the broadest permissible interpretation of the following claims and their equivalents, and shall not be restricted or limited by the foregoing detailed description.

What is claimed is:

1. A high-performance single barrel power connector comprising:

a connector body configured with an opening for receiving a power plug of a power source;

a V− pin comprising a V− pin first end with a plurality of V− pin contact areas and a V− pin second end with a pair of V− pin contact points, wherein the V− pin first end is accessible through the opening in the connector body;

a V+ pin having a V+ pin first end with a plurality of V+ pin contact areas and a V+ pin second end with a pair of V+ pin contact points, the V+ pin first end is accessible through the opening in the connector body and aligned coaxial with the V− pin;

a signal pin having a signal pin first end and a signal pin second end, wherein the signal pin first end is accessible through the opening in the connector body and aligned coaxial with the V− pin;

a cover connected to the connector body, wherein the V− pin contact points, the V+ pin contact points and the signal pin second end extend through the cover; and a shell coupled to the connector body, the shell formed from a high thermal conductivity material and comprising:

a first set of V− pin tabs for contact with the first end of the V− pin and a second set of V− pin tabs for contact with the V− pin contact points.

2. The high-performance single barrel power connector of claim 1, wherein the connector body comprises one or more openings to expose a portion of one or more of the V− pin and the V+ pin to ambient air.

3. The high-performance single barrel power connector of claim 2, wherein the shell comprises a set of retainers for coupling the shell to the connector body and the cover.

4. The high-performance single barrel power connector of claim 3, wherein the shell comprises C5210.

5. The high-performance single barrel power connector of claim 1, wherein the V− pin contact points are separated from each other by a distance and oriented at an angle relative to each other.

6. The high-performance single barrel power connector of claim 5, wherein the V− pin contact points are oriented at an angle between forty-five degrees and ninety degrees relative to each other.

7. The high-performance single barrel power connector of claim 1, wherein:

the V− pin comprises brass; and the V+ pin comprises copper.

8. A method for manufacturing a high-performance single barrel power connector, the method comprising:

forming a connector body with an opening configured for receiving a power plug corresponding to a power source;

positioning a V− pin in the connector body, wherein a V− pin first end is accessible through the opening in the connector body and the V− pin first end comprises a plurality of V− pin contact areas configured for contact with the power plug, wherein the V− pin further comprises a V− pin second end with a pair of V− pin contact points;

positioning a V+ pin in the connector body, wherein a V+ pin first end is accessible through the opening in the connector body and comprises a plurality of V+ pin contact areas configured for contact with the power plug, wherein a V+ pin second end comprises a pair of V+ pin contact points, and the V+ pin is aligned coaxial with the V− pin;

positioning a signal pin in the connector body, wherein a signal pin first end is accessible through the opening in the connector body, wherein the signal pin comprises a signal pin second end and is aligned coaxial with the V− pin;

connecting a cover to the connector body, wherein the pair of V− pin contact points, the pair of V+ pin contact points and the signal pin second end extend through the cover; and coupling a shell formed from a high thermal conductivity material to the connector body, wherein coupling to shell to the connector body comprises:

positioning a first set of V− pin tabs in contact with the pair of V− pin contact points, positioning a deflectable tab in contact with the V− pin first end.

9. The method of claim 8, further comprising forming the connector body with one or more openings to expose a portion of one or more of the V− pin and the V+ pin to ambient air.

10. The method of claim 9, further comprising forming the shell with a set of retainers for coupling the shell to the connector body and the cover.

11. The method of claim 8, further comprising forming the shell with C5210 alloy.

12. The method of claim 8, further comprising forming the V− pin with the V− pin contact points separated from each other by a distance and oriented at an angle relative to each other.

13. The method of claim 12, wherein the V− pin contact points are oriented at an angle between forty-five degrees and ninety degrees relative to each other.

14. The method of claim 8, further comprising:

forming the V− pin with brass; and forming the V+ pin with copper.

15. An information handling system comprising:

a plurality of components for processing information;

a power supply comprising a single-barrel plug for providing electric power to the information handling system; and a power connector for receiving power from the plug, the power connector comprising:

a connector body configured with an opening for receiving the plug;

a V− pin comprising a V− pin first end with a plurality of V− pin contact areas and a V− pin second end with a pair of V− pin contact points, wherein the V− pin first end is accessible through the opening in the connector body;

a V+ pin having a V+ pin first end with a plurality of V+ pin contact areas and a V+ pin second end with a pair of V+ pin contact points, the V+ pin first end is accessible through the opening in the connector body and aligned coaxial with the V− pin;

a signal pin having a signal pin first end and a signal pin second end, wherein the signal pin first end is accessible through the opening in the connector body and aligned coaxial with the V− pin;

a cover connected to the connector body, wherein the V− pin contact points, the V+ pin contact points and the signal pin second end extend through the cover; and a shell coupled to the connector body, the shell formed from a high thermal conductivity material and comprising:

a first set of V− pin tabs for contact with the first end of the V− pin and a second set of V− pin tabs for contact with the V− pin contact points.

16. The information handling system of claim 15, further comprising a thermally conductive bracket coupled to the chassis, wherein:

the shell comprises:

a set of retainers for coupling the shell to the connector body and the cover; and a set of raised contact areas for contact between the shell and the bracket.

17. The information handling system of claim 15, wherein the connector body comprises one or more openings to expose a portion of one or more of the V− pin and the V+ pin to ambient air.

18. The information handling system of claim 15, wherein the V− pin contact points are separated from each other by a distance and oriented at an angle relative to each other.

19. The information handling system of claim 15, wherein the V− pin contact points are oriented at an angle between forty-five degrees and ninety degrees relative to each other.

20. The information handling system of claim 15, wherein:

the V− pin comprises brass; and the V+ pin comprises copper.

* * * * *